US009118145B2

(12) United States Patent
Tsang et al.

(10) Patent No.: US 9,118,145 B2
(45) Date of Patent: Aug. 25, 2015

(54) LATCH ASSEMBLIES FOR CONNECTOR SYSTEMS

(71) Applicant: Tyco Electronics Corporation, Berwyn, PA (US)

(72) Inventors: Albert Tsang, Harrisburg, PA (US); Brent David Yohn, Newport, PA (US); Chong Hun Yi, Mechanicsburg, PA (US); Kevin Michael Thackston, York, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 147 days.

(21) Appl. No.: 13/840,450

(22) Filed: Mar. 15, 2013

(65) Prior Publication Data

US 2013/0337671 A1 Dec. 19, 2013

Related U.S. Application Data

(60) Provisional application No. 61/661,207, filed on Jun. 18, 2012.

(51) Int. Cl.

| | |
|---|---|
| ***H01R 13/62*** | (2006.01) |
| ***H01R 13/627*** | (2006.01) |
| ***H01R 13/629*** | (2006.01) |
| ***H01R 13/633*** | (2006.01) |
| ***H01R 13/74*** | (2006.01) |

(52) U.S. Cl.

CPC ..... *H01R 13/6275* (2013.01); *H01R 13/62911* (2013.01); *H01R 13/6335* (2013.01); *H01R 13/745* (2013.01)

(58) Field of Classification Search

CPC ..... H01R 13/62933; H01R 13/62938; H01R 13/633; H01R 13/635; H01R 13/639

USPC ..... 439/157, 159, 160, 310, 347, 372

See application file for complete search history.

(56) References Cited

U.S. PATENT DOCUMENTS

| | | | | |
|---|---|---|---|---|
| 5,627,974 | A | 5/1997 | Watts, Jr. et al. | |
| 5,791,931 | A | 8/1998 | Burkhart, Sr. | |
| 5,871,363 | A * | 2/1999 | Kimura | 439/157 |

(Continued)

FOREIGN PATENT DOCUMENTS

| | | |
|---|---|---|
| DE | 103 30 853 A1 | 2/2005 |
| DE | 10 2004 042 586 B3 | 12/2005 |

(Continued)

OTHER PUBLICATIONS

International Search Report, International Application No. PCT/US2013/046083, International Filing Date, Jun. 17, 2013.

*Primary Examiner* — Thanh Tam Le

(57) ABSTRACT

A connector system includes a base mount and a slider latch received in the base mount. The slider latch has a profiled groove configured to latchably receive a cam of a connector module. A faceplate is coupled to the base mount. The faceplate has an opening providing access to the slider latch. An ejector button is operatively coupled to the slider latch to move the slider latch from a latched position to an unlatched position. The slider latch is configured to eject the connector module as the slider latch moves between the latched and unlatched positions. A spring engages the slider latch and acts on the slider latch in a biasing direction. The spring forces the slider latch to return to the latched position after the ejector button is released.

18 Claims, 10 Drawing Sheets

(56) References Cited

U.S. PATENT DOCUMENTS

| | | | | |
|---|---|---|---|---|
| 5,888,080 | A * | 3/1999 | Maejima | 439/157 |
| 5,899,762 | A * | 5/1999 | Ainceri | 439/157 |
| 5,967,808 | A * | 10/1999 | Kubota | 439/157 |
| 6,062,882 | A * | 5/2000 | Hanazaki et al. | 439/157 |
| 6,183,279 | B1 * | 2/2001 | Murakami et al. | 439/157 |
| 6,193,530 | B1 * | 2/2001 | Sakurai et al. | 439/157 |
| 6,244,880 | B1 * | 6/2001 | Fukase et al. | 439/157 |
| 6,254,407 | B1 * | 7/2001 | Burns | 439/157 |
| 6,979,213 | B1 * | 12/2005 | Mauney et al. | 439/157 |
| 7,416,426 | B2 * | 8/2008 | Tyler et al. | 439/157 |
| 2010/0035450 | A1 | 2/2010 | Chang et al. | |

FOREIGN PATENT DOCUMENTS

| | | | |
|---|---|---|---|
| EP | 1 696 516 | A1 | 8/2006 |
| WO | 96 12325 | A1 | 4/1996 |

* cited by examiner

LATCH ASSEMBLIES FOR CONNECTOR SYSTEMS

CROSS REFERENCE TO RELATED APPLICATIONS

This application claims the benefit of U.S. Provisional Application No. 61/661,207 filed Jun. 18, 2012 titled LATCH ASSEMBLIES FOR CONNECTOR SYSTEMS, the subject matter of which is herein incorporated by reference in its entirety.

BACKGROUND OF THE INVENTION

The subject matter herein relates generally to latch assemblies for connector systems.

Connector systems typically include electrical connectors and mating electrical connectors configured to be mated with corresponding electrical connectors. In some applications, the electrical connectors are part of a backplane and the mating electrical connectors are part of a daughtercard. The electrical connectors are coupled to the backplane and positioned for mating with the mating electrical connectors. The electrical connectors need to be mounted to the backplane.

Current retention methods include designs with screws that secure the electrical connectors to the backplane. Such retention methods require tools to assemble and unassembled, which is time consuming. Also, problems with foreign objects and/or debris introduced prior to or during assembly cause problems in assembly. Also, loosening of the screws due to vibration is another potential problem.

A need remains for a mechanism to retain an electrical connector to a surface in such a way to create a simple interface. A need remains for a tool-less means of attaching electrical connectors to a backplane.

BRIEF DESCRIPTION OF THE INVENTION

In one embodiment, a connector system is provided including a base mount configured to hold a connector module therein and a slider latch received in the base mount and movable in a longitudinal direction. The slider latch has a profiled groove configured to latchably receive a cam of the connector module. A faceplate is coupled to the base mount. The faceplate has an opening providing access to the slider latch. The base mount is configured to receive the connector module through the opening in the faceplate. An ejector button is operatively coupled to the slider latch to move the slider latch from a latched position to an unlatched position. The slider latch is configured to eject the connector module as the slider latch moves between the latched and unlatched positions. A spring engages the slider latch and acts on the slider latch in a biasing direction. The spring forces the slider latch to return to the latched position after the ejector button is released.

In another embodiment, a connector system is provided having a backplane having a connector channel therethrough and a connector module received in the connector channel for mating with a mating connector module. The connector module has a profiled cam. A latch assembly releasable couples the connector module to the backplane. The latch assembly includes a base mount configured to hold a connector module therein and a slider latch received in the base mount and movable in a longitudinal direction. The slider latch has a profiled groove configured to latchably receive a cam of the connector module. A faceplate is coupled to the base mount. The faceplate has an opening providing access to the slider latch. The base mount is configured to receive the connector module through the opening in the faceplate. An ejector button is operatively coupled to the slider latch to move the slider latch from a latched position to an unlatched position. The slider latch is configured to eject the connector module as the slider latch moves between the latched and unlatched positions. A spring engages the slider latch and acts on the slider latch in a biasing direction. The spring forces the slider latch to return to the latched position after the ejector button is released.

DETAILED DESCRIPTION OF THE INVENTION

Figure 1:
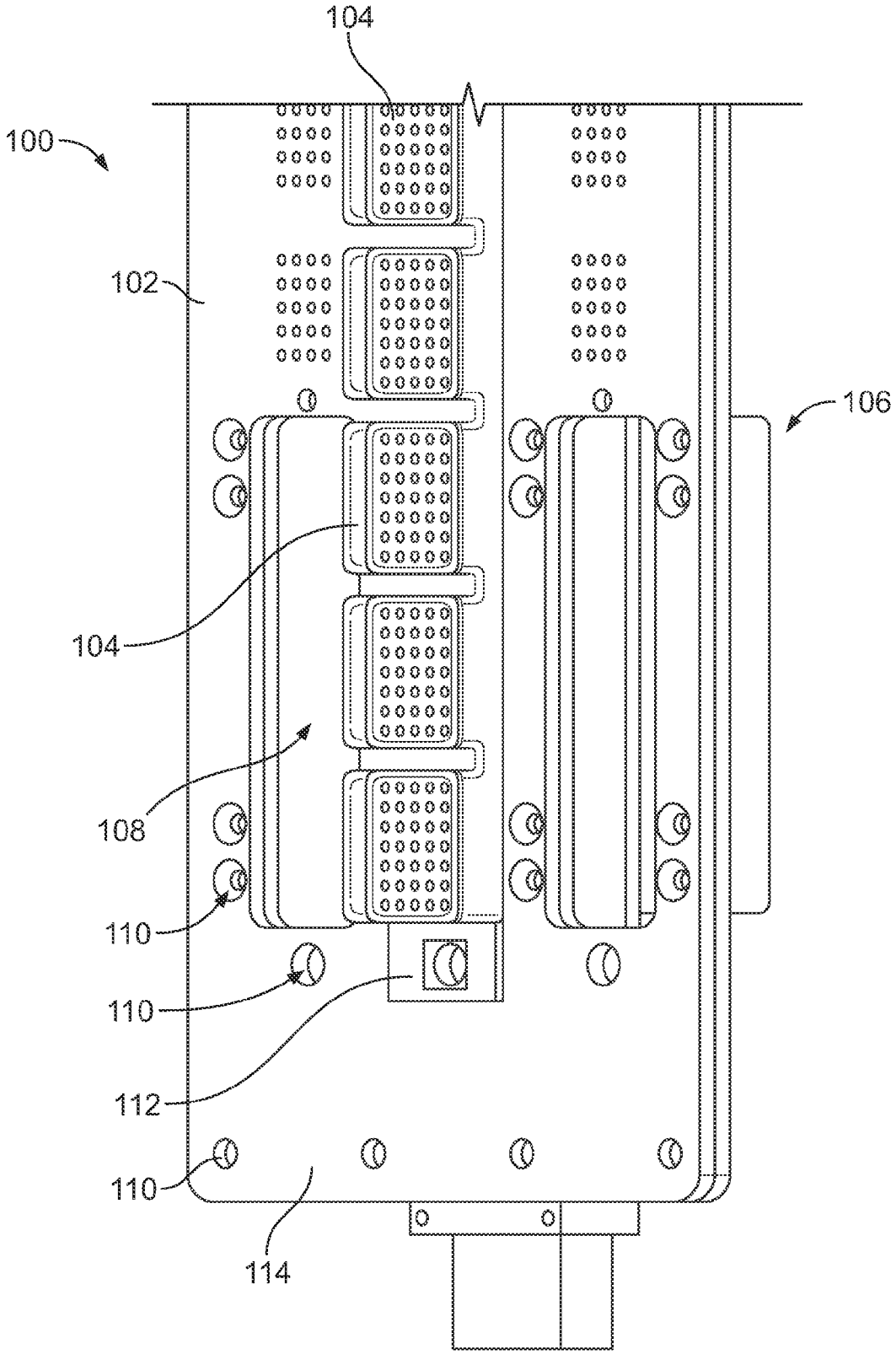
FIG. 1 is a front perspective view of a connector system formed in accordance with an exemplary embodiment.

FIG. 1 is a front perspective view of a connector system 100 formed in accordance with an exemplary embodiment. The connector system 100 includes a backplane 102 having a plurality of electrical connectors 104 mounted thereto. The electrical connectors 104 are configured to be electrically connected to corresponding mating electrical connectors (not shown) as part of a network system, a server, or other type of system. For example, the mating electrical connectors may be part of a daughter card that is made into the backplane 102. The electrical connectors 104 may be plug connectors, receptacle connectors, header connectors, or other types of connectors. Any number electrical connectors 104 may be coupled to the backplane. The electrical connectors 104 may be board mounted electrical connectors, which are directly terminated to the circuit board of the backplane 102, or the electrical connectors 104 may be cable mounted electrical connectors, which may be connected to other components within the system by cables. FIG. 1 illustrates electrical connectors 104 along a single column and it is realized that other electrical connectors 104 may be coupled to the backplane 102 in other columns.

In an exemplary embodiment, the backplane 102 includes both board mounted electrical connectors and cable mounted electrical connectors, both generally designated by reference 104. A single daughter card may have mating electrical connectors that are electrically connected to and mated with corresponding board mounted electrical connectors and cable mounted cable connectors. The cable mounted electrical connectors 104 are part of connector modules 106 that are coupled to the backplane 102. The backplane 102 includes channels 108 through which the connector modules 106 partially extend.

The backplane 102 includes a plurality of openings 110. The openings 110 may be used to mount components to the backplane 102. For example, latch assemblies 120 (shown in FIG. 2) may be coupled to the backplane 102 and used to couple the connector modules 106 to the backplane 102. The latches assemblies 120 may be coupled to the backplane 102 using fasteners that extend into and/or through the openings 110.

Metal shells 112 may be coupled to a front surface 114 of the backplane 102. The metal shells 112 may protect the electrical connectors 104. The metal shells 112 may provide a structure for mating the mating electrical connectors and/or the daughter cards to the backplane 102. The metal shells 112 may be coupled to the backplane 102 using fasteners that extend into and/or through the openings 110.

The electrical connectors 104 may be any type of connectors. The electrical connectors 104 may include a plurality of contacts or terminals that are configured to be mated to corresponding contacts or terminals of the mating electrical connectors. The contacts or terminals may be terminated directly to the circuit board of the backplane 102, such as by surface mounting or through hole mounting to the backplane 102. Alternatively, the contacts or terminals may be terminated to ends of wires of the cables of the cable mounted electrical connectors. The contacts of terminals may be any types of contacts or terminals, such as pins, sockets, blades, tuning forks, plugs, receptacles, and the like. The electrical connectors may be fiber optic connectors in alternative embodiments.

Figure 2:
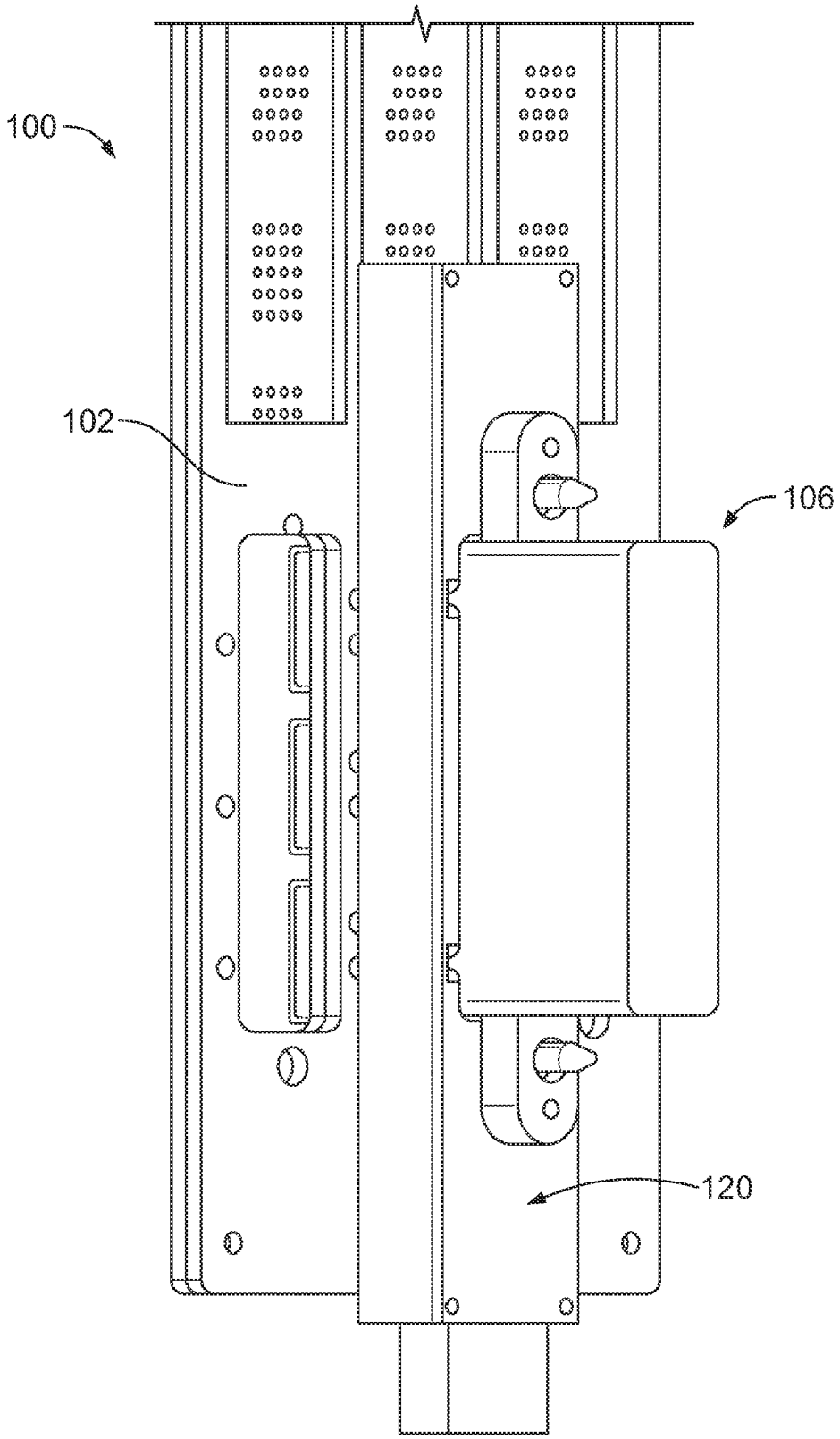
FIG. 2 is a rear perspective view of the connector system illustrating a latch assembly coupled to a backplane and a connector module coupled to the latch assembly 120.
Figure 3:
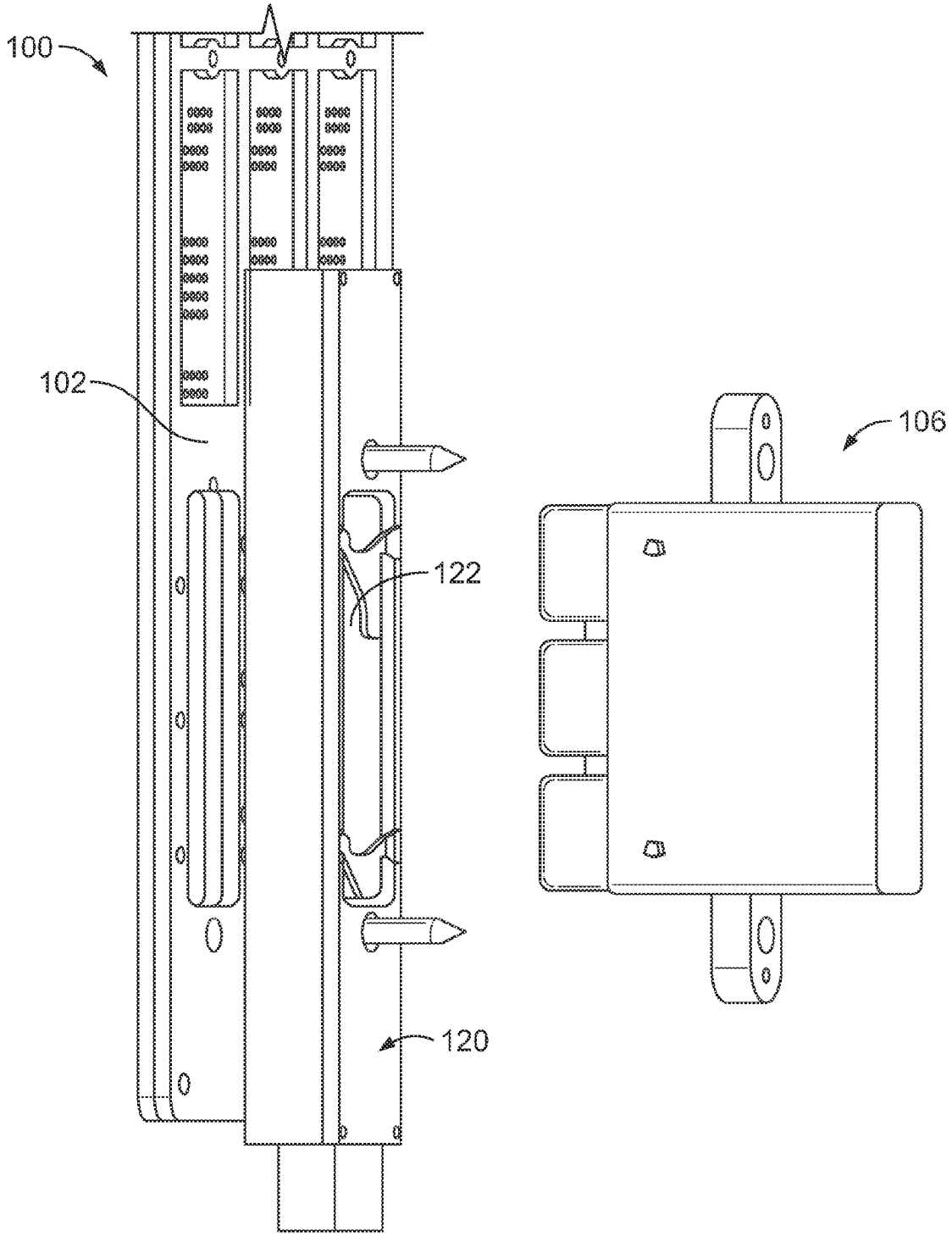
FIG. 3 is a rear perspective view of the connector system showing the connector module poised for mating with the latch assembly.

FIG. 2 is a rear perspective view of the connector system 100 illustrating the latch assemblies 120 coupled to the backplane 102 and the connector module 106 coupled to the latch assembly 120. FIG. 3 is a rear perspective view of the connector system 100 showing the connector module 106 poised for mating with the latch assembly 120. In an exemplary embodiment, the latch assembly 120 allows for quick connection and quick disconnection of the connector module 106 from the backplane 102. For example, the latch assembly 120 includes a slide latch 122 that allows the connector module 106 to be easily plugged and unplugged from the latch assembly 120. The connector module 106 is coupled to the latch assembly 120 without the use of threaded fasteners or other types of connectors or fastener that are time consuming to attach and unattached.

Figure 4:
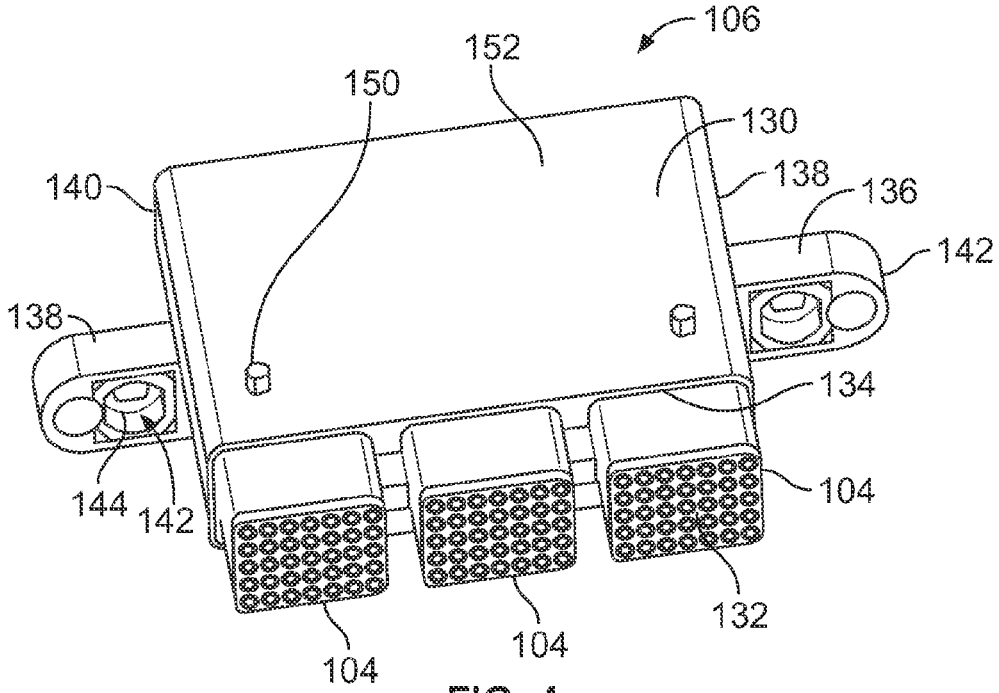
FIG. 4 is a front perspective view of the connector module.
Figure 5:
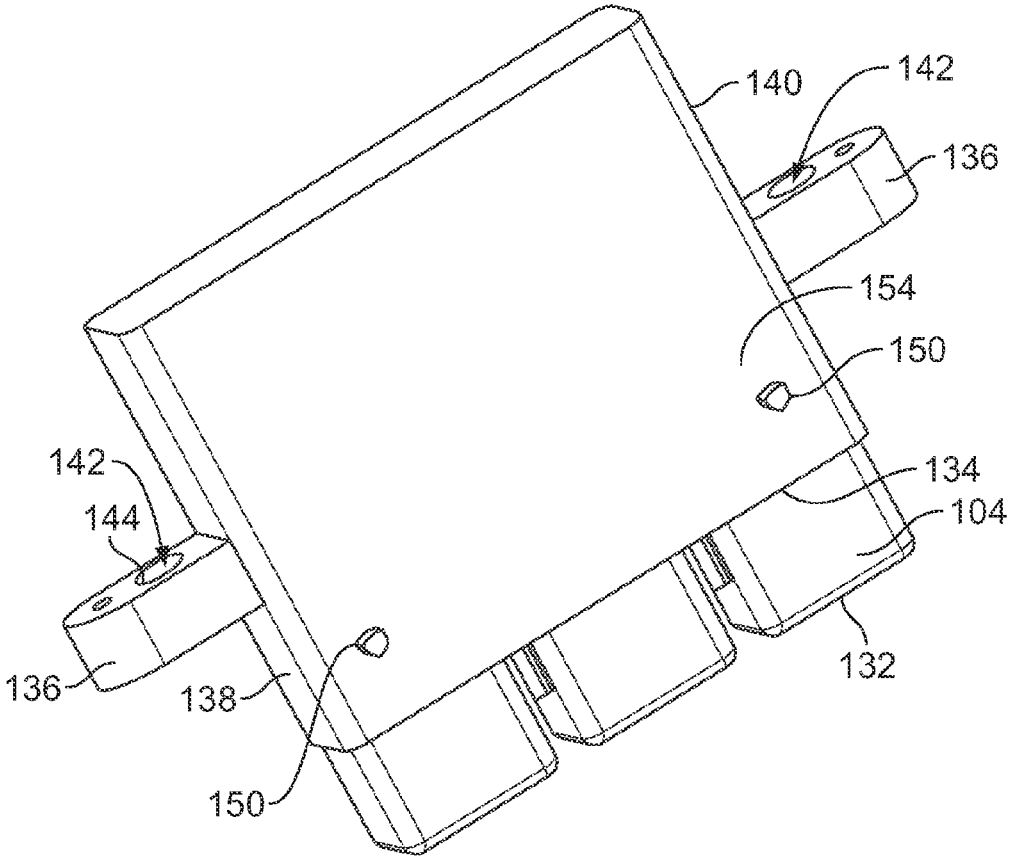
FIG. 5 is a rear perspective view of the connector module.

FIG. 4 is a front perspective view of the connector module 106. FIG. 5 is a rear perspective view of the connector module 106. The connector module 106 includes a plurality of the electrical connectors 104. The electrical connectors 104 are held within a back shell 130, which may be a metal box or container that holds the electrical connectors 104 in predetermined positions with respect to one another. Any number of electrical connectors 104 may be held within the back shell 130 depending on the particular application. In the illustrated embodiment, the back shell 130 is generally rectangular in shape, however, other shapes are possible in alternative embodiments. Mating ends 132 of the electrical connectors 104 extend beyond a front 134 of the back shell 130. The mating ends 132 are configured to extend into the backplane 102 (shown in FIG. 1) from mating with the corresponding mating connectors.

The connector module 106 includes mounting lugs 136 extending from opposite sides 138, 140 of the back shell 130. The mounting lugs 136 are used to mount the connector module 106 to the latch assembly 120 (shown in FIG. 2). The mounting lugs 136 may be formed integrally with the back shell 130. Alternatively, the mounting lugs 136 may be coupled to the back shell 130. The mounting lugs 136 include post holes 142 extending therethrough. In an exemplary embodiment, the post holes 142 are keyed to define a particular type of connector module 106 that is configured to be mated with a particular type of latch assembly 120. For example, the shape of the post holes 142 may be irregular for receiving a post having a complementary shape. In the illustrated embodiment, the post holes 142 are generally cylindrical and have a flat surface 144 at a particular radial position along the post hole 142. By changing the location of the flat surface 144, different types of connector modules may be defined. The post holes 142 may have other shapes in alternative embodiments.

The connector module 106 includes cams 150 extending from a top 152 and a bottom 154 of the back shell 130. The cams 150 interact with the latch assemblies 120 to secure the connectors modules 106 within the latch assemblies 120.

Figure 6:
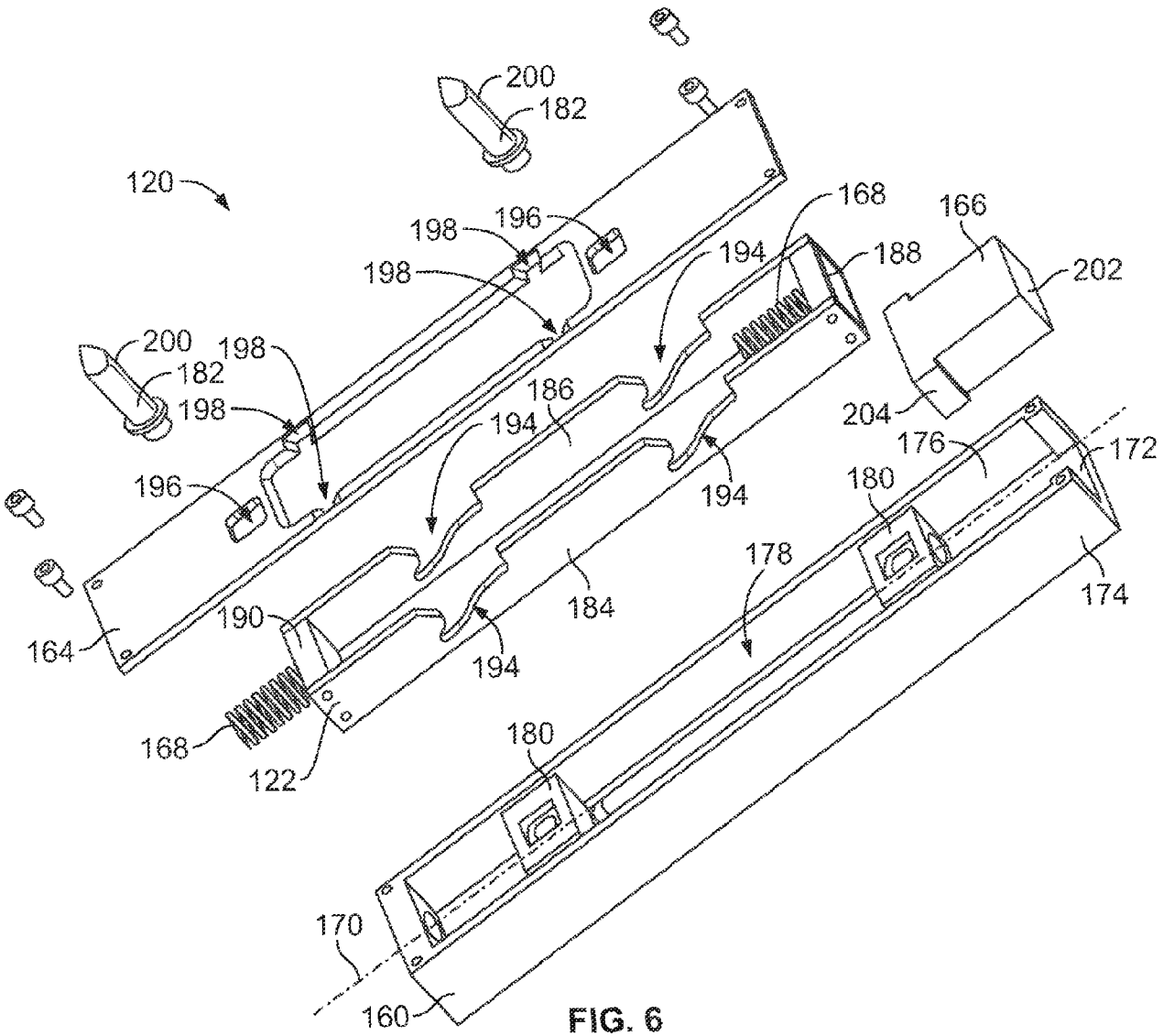
FIG. 6 is an exploded view of the latch assembly.

FIG. 6 is an exploded view of the latch assembly 120. The latch assembly 120 includes a base mount 160, a slider latch 122, a face plate 164 an ejector button 166 and one or more springs 168. The slider latch 122, ejector button 166 and springs 168 are received in the base mount 160. The face plate 164 is coupled to the base mount 160 to hold the components therein. The slider latch 122 is movable within the base mount 160 in a longitudinal direction along a longitudinal axis 170 of the latch assembly 120. The latch assembly 120 retains the connector module 106 (shown in FIG. 5) to the backplane 102 (shown in FIG. 1). The latch assembly 120 may provide a simple interface for securing the connector module 106. The latch assembly 120 secures the connector module 106 without the need for tools or separate fasteners. In an exemplary embodiment, the latch assembly 120 can be operated with one hand. The latch assembly 120 can be actuated quickly to eject the connector module 106. The latch assembly 120 is narrow and allows the connector modules 106 to be stacked side by side on a tight pitch, such as less than 1 inch.

The base mount 160 includes a base 172 and sidewalls 174, 176 extending from the base 172. A pocket 178 is defined by the base 172 and side walls 174, 176. The pocket 178 may be open general opposite the base 172. In an exemplary embodiment, the base mount 160 includes post mounts 180 in the pocket 178 extending from the base 172. Guide posts 182 are configured to be mounted to the post mounts 180. The guide posts 182 guide mating of the connector module 106 (shown in FIG. 2) with the latch assembly 120. The connector module 106 is configured to be at least partially received within the pocket 178. The slider latch 122 is configured to be received within the pocket 178 to engage in the connector module 106 to hold the connector module 106 in the base mount 160. In an exemplary embodiment, the base mount 160 may be coupled directly to the backplane 102 (shown in FIG. 1) or alternatively may be coupled to a stiffener or other structure coupled to the backplane 102. In other alternative embodiments, the base mount 160 may be integrally formed with a stiffener coupled to the backplane 102.

The slider latch 122 includes side walls 184, 186 and end walls 188, 190. The sidewalls 184, 186 extend longitudinally along the longitudinal axis 170. The springs 168 are configured to engage the end walls 188, 190 and impart a biasing force on the slider latch 122 against the end walls 188, 190. The side walls 184, 186 include profiled grooves 192 that are configured to receive corresponding cams 150 (shown in FIGS. 4 and 5). The cams 150 are captured in the profiled grooves 192 to secure the connector modules 106 to the latch assembly 120. The cams 150 have controlled movements along the profiled grooves 192 defined by surfaces of the profiled grooves 192. Any number of profiled grooves 192 may be provided. In the illustrated embodiment, each side wall 184, 186 include two profiled grooves. The profiled grooves 192 are aligned with each other across the slider latch 122. Alternatively, the profiled grooves 192 may be offset or not aligned across the slider latch 122.

The face plate 164 is a planar structure configured to be coupled to the base mount 160 over the slider latch 122. The face plate 164 includes an opening therethrough that provides access to the pocket 178 and the slider latch 122. The connector module 106 is configured to be loaded into the latch assembly 120 through the opening 194. The face plate 164 includes post openings 196 aligned to receive the guide post 182. In an exemplary embodiment, the face plate 164 may be coupled to the base mount 160 using fasteners. Other fastening means may be used in alternative embodiments to couple the face plate 164 to the base mount 160.

The face plate 164 includes cutouts 198 in the opening 194. The cutouts 198 are configured to receive corresponding cams 150 therethrough as the connector module 106 is loaded into the base mount 160. The cutouts 198 are aligned with corresponding profiled grooves 192 to receive the cams 150. Optionally, the cutouts 198 may be aligned across the opening 194. Alternatively, the cutouts 198 may be offset. Having the cutouts 198 offset may provide a feature for polarizing the mating of the connector module 106 with the latch assembly 120. For example, the cutouts 198 may be positioned such that the connector module 106 may be loaded into the latch assembly 120 in only one way. For example, cutouts 198 on one side of the opening 194 may have a first spacing therebetween and cutouts 198 on the other side of the opening 194 may have a second spacing therebetween different from the first spacing. The cams 150 on one side may correspond to the first spacing and the cams 150 on the other side may correspond to the second spacing such that the connector module 106 may only be loaded into the opening 194 in one way.

The guide posts 182 are coupled to the post mounts 180 and extend from the faceplate 164 to interact with the connector module 106 during mating of the connector module 106 with the latch assembly 120. In an exemplary embodiment, the guide posts 182 have flat sides 200 that interact with the flat surfaces 144 of the post holes 142 (both shown in FIG. 3) to key the connector module 106 with the latch assembly 120. Optionally, the guide post 182 may be coupled to the post mounts 180 at different angular positions that change the location of the flat sides 200. For example, the guide post 182 may be received within the post mounts 180 at multiple rotational positions. For example, the guide post 182 may have an octagonal shape at the mounting end that allows the guide post 182 to be loaded into the post mounts 180 at eight different positions. Depending on the position of the guide post 182, different types of connectors modules 106 may be coupled to the latch assembly 120. An embodiment having two guide post 182 each having eight different, distinct positions provides a total of 64 different combinations of keys for mating with 64 different types of connector modules 106.

The ejector button 166 has an actuation end 202 that is configured to be located outside of the base mount 160 to be pressed by an operator to release the slider latch 122 to eject the connector module 106 from the latch assembly 120. The ejector button 166 has a head 204 opposite the actuation end 202 that is captured in the pocket 178. The ejector button 166 may be pressed in the direction along the longitudinal axis 170 to move the slider latch 122 between a latched position and an unlatched position, the latched and unlatched positions may correspond to unactuated and actuated positions of the ejector button 166. Actuation of the slider latch 122 ejects the connector module 106 from the latch assembly 120.

Figure 7:
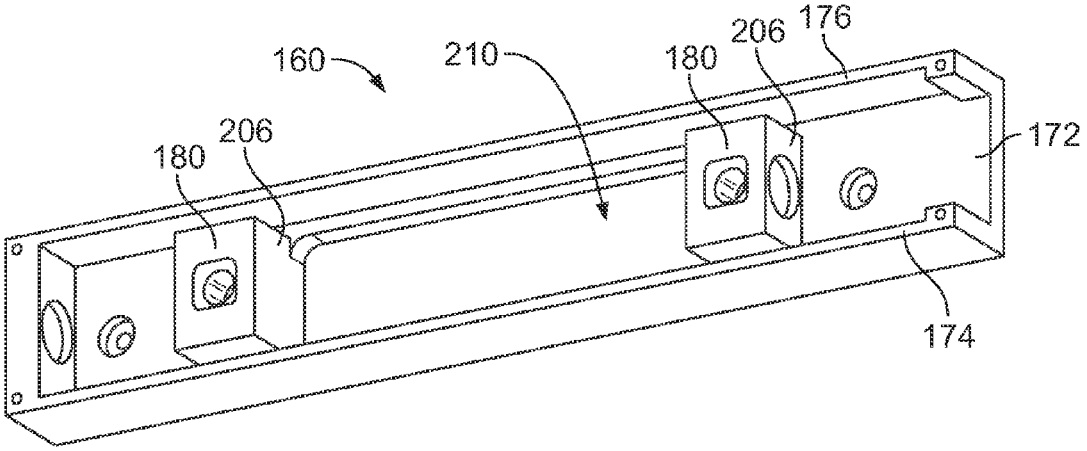
FIG. 7 is a perspective view of a base mount of the latch assembly.

FIG. 7 is a perspective view of the base mount 160. The base mount 160 includes an opening 210 through the base 172. A portion of the connector module 106 (shown in FIG. 1) may be loaded through the opening 210 to be presented at the backplane 102 for mating with the mating electrical connector. As shown in FIG. 7, spaces are provided between the post mounts 180 and the side walls 174, 176. Such spaces receive the side walls 184, 186 of the slider latch 122 (shown in FIG. 6). In an exemplary embodiment, sides of the post mounts 180 define biasing surfaces 206 for the springs 168 (shown in FIG. 6) to bias against.

Figure 8:
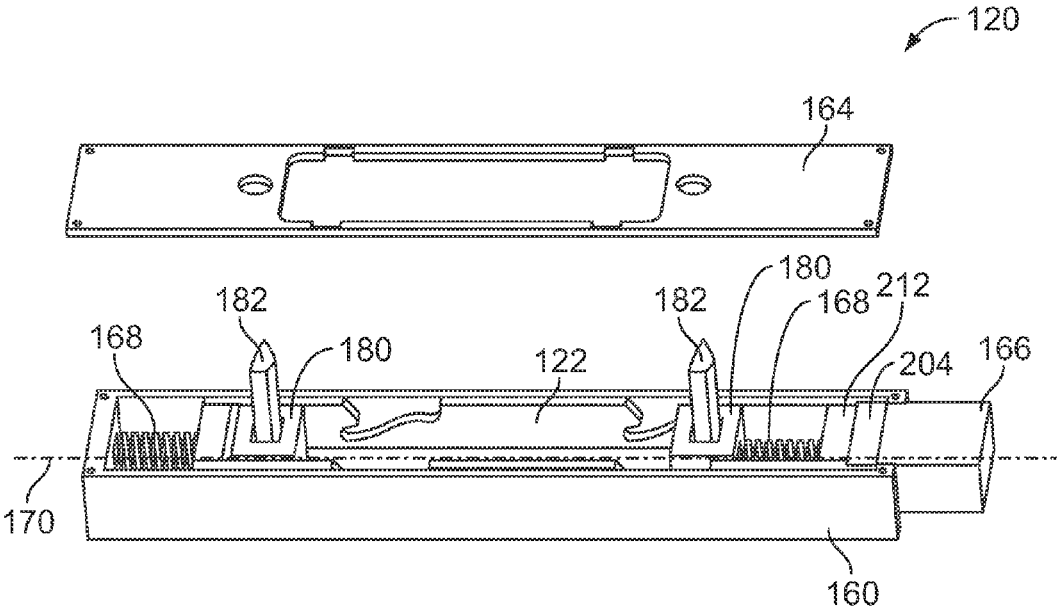
FIG. 8 is a partial assembled view of the latch assembly.

FIG. 8 is a partial assembled view of the latch assembly 120 showing the face plate 164 poised for mounting to the base mount 160 over the slider latch 122, the ejector button 166, and the springs 168. The guide posts 182 are shown mounted to the post mounts 180. The head 204 of the ejector button 166 engages an end 212 of the slider latch 122. When the ejector button 166 is pressed inward, the slider latch 122 is moved in a longitudinal direction along the longitudinal axis 170 from the latched position (shown in FIG. 8) to an unlatched position.

Figure 9:
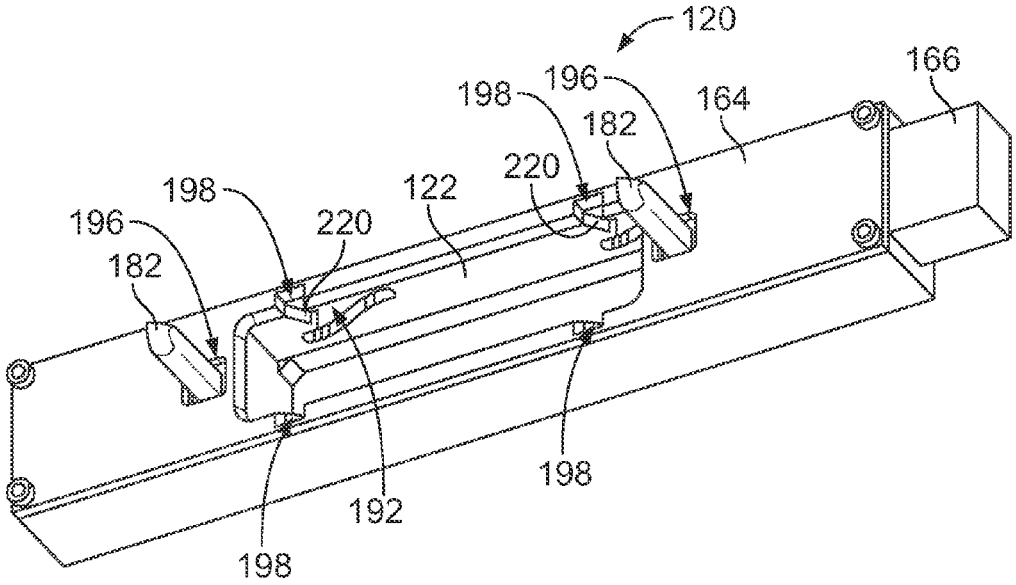
FIG. 9 illustrates the latch assembly in an assembled stated.

FIG. 9 illustrates the latch assembly 120 in an assembled stated. The guide posts 182 are shown extending through the post openings 196 in the face plate 164. The cutouts 198 are aligned with the profiled grooves 192. When the connector module 106 (shown in FIG. 1) is loaded into the latch assembly 120, the cams 150 pass through the cutouts 198 directly into the profiled groves 192. Pressing of the connector module 106 in a loading direction causes the cams 150 to engage the profiled groves 192. As the connector module 106 is continued to be pressed into the latch assembly 120, the slider latch 122 is automatically shifted from the latched position toward the unlatched position. The slider latch 122 is automatically unlatched without needing to press the ejector button 166. The connector module 106 continues to be loaded into the latch assembly 120 until the cams 150 clear blockers 220 of the slider latch 122, at which time the slider latch 122 snaps back to a latched position in which the cams 150 are captured in the profiled groves 192. The springs 168 (shown in FIG. 6) press against the slider latch 122 to snap the slider latch 122 into the latched position.

Figure 10:
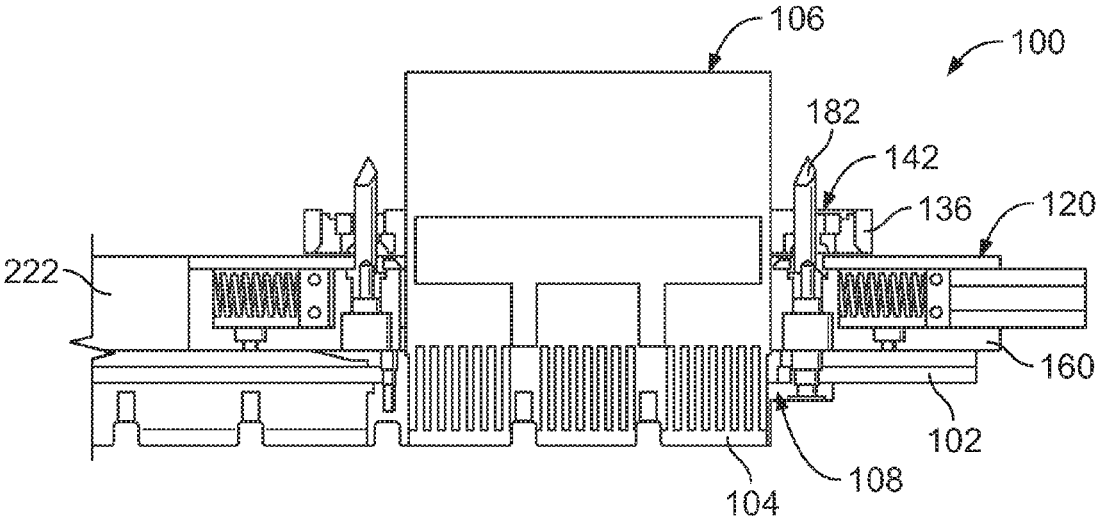
FIG. 10 is a side, partial sectional view of the connector system.

FIG. 10 is a side, partial sectional view of the connector system 100. The latch assembly 120 is coupled to a stiffener 222 of the backplane 102. The stiffener 222 is coupled to the backplane 102 and provides rigidity to the backplane 102. The latch assembly 120 may be secured to the stiffener 222 using fasteners or other fastening means. Alternatively, the base mount 160 may be integrally formed with the stiffener 222.

The connector module 106 is shown coupled to the latch assembly 120. The connector module 106 is loaded into the latch assembly 120 such that a portion of the connector module 106 extends through the latch assembly 120 into the backplane 102. The connector module 106 is loaded through the channels 108 in the backplane 102. The electrical connectors 104 are presented at the backplane 102 for mating with the electrical connectors of the daughter card. The guide posts 182 are coupled to the mounting lugs 136. For example, the guide posts 182 extend through the post holes 142 and the mounting lugs 136. The guide post 182 position the connector module 136 with respect to the base mount 160 and the backplane 102. The guide posts 182 align the electrical connectors 104 with the channel 108 and the backplane 102.

Figure 11:
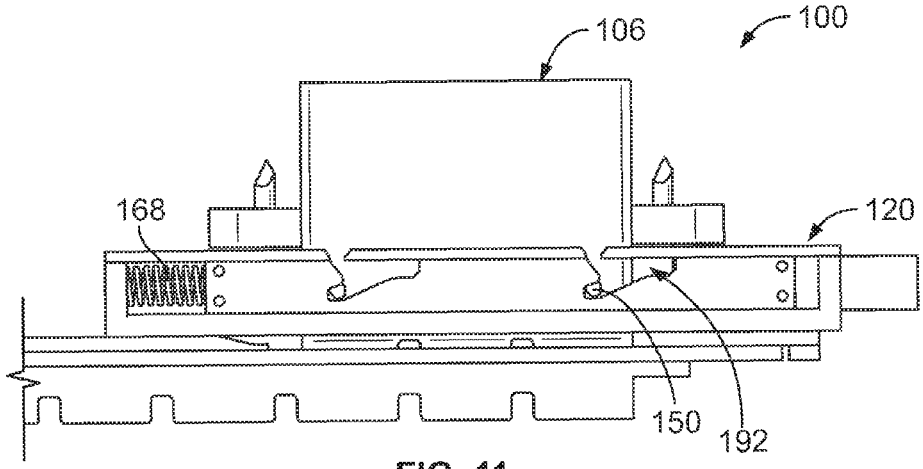
FIG. 11 is a side, partial sectional view of the connector system.

FIG. 11 is a side, partial sectional view of the connector system 100 showing the cams 150 interacting with the profiled grooves 192 of the slider latch 122. The slider latch 122 latches the connector module 106 within the latch assembly 120 by resisting removal of the cams 150 from the profiled groves 192. The springs 168 are biased against the slider latch 122 in the latched position. In the latched position, the slider latch 122 covers the cams 150 to resist removal of the connector module 106 from the latch assembly 120.

Figure 12:
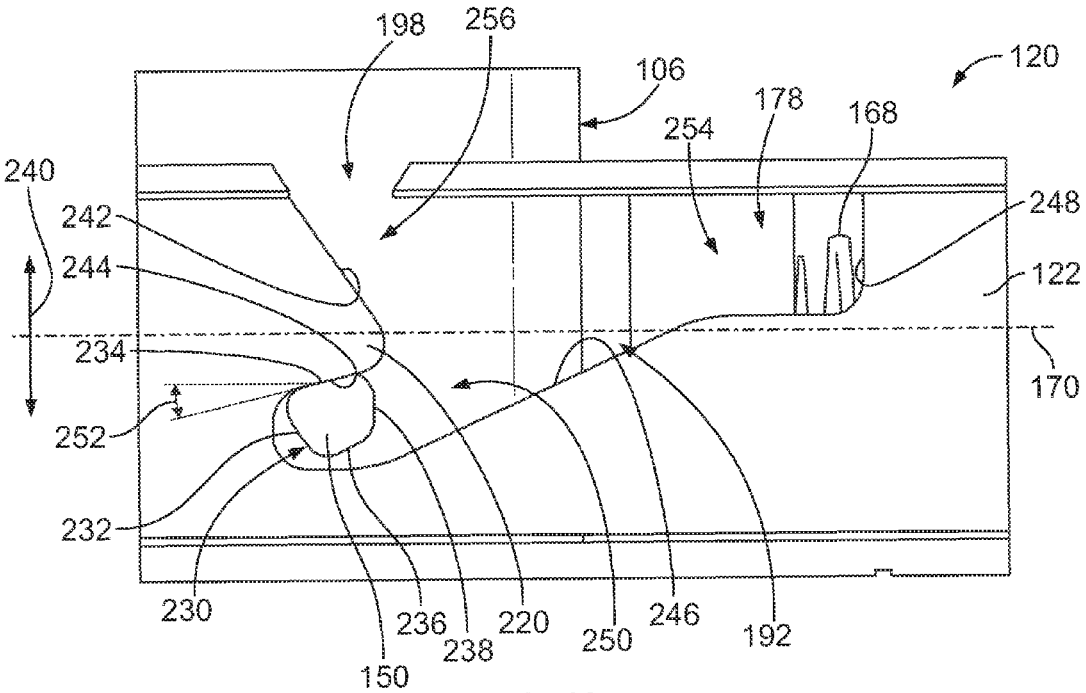
FIG. 12 is an exploded view of a portion of the connector system.

FIG. 12 is an exploded view of a portion of the connector system 100 showing the interaction between the cam 150 and the profiled groove 192. In an exemplary embodiment, the cam 150 includes a profiled cam surface 230. The profiled cam surface 230 has a plurality of flat surfaces that are angled with respect to one another. In an exemplary embodiment, the angled surfaces are angled at non-orthogonal angles. The angled surfaces correspond to surfaces of the profiled grooves 192 to control movement of the cams 150 along the profiled grooves 192 as the connector module 106 is being plugged into the latch assembly 120 and as the connector module 106 is being ejected from the latch assembly 120.

In an exemplary embodiment, the cam 150 includes a first inclined surface 232, a second inclined surface 234, and third inclined surface 236 and a fourth inclined surface 238. The cam 150 may include other inclined surfaces in addition to the incline surfaces 232-238. The inclined surfaces 232-238 are configured to engage different portions of the profiled grove 192 as the slider latch 122 is moved between the latched position and the unlatched position.

The profiled grove 192 includes a plurality of inclined surfaces that are configured to guide the cam 150 into and out of the pocket 178. In an exemplary embodiment, the connector module 106 and cam 150 move linearly along a plug/unplug axis 240 while the slider latch 122 moves linearly along the longitudinal axis 170. During plugging of the connector module 106 into the latch assembly 120, the cam 150 drives the slider latch 122 along the longitudinal axis 170. To remove the connector module 106, the slider latch 122 is moved along the longitudinal axis 170 to drive the cam out of the pocket 178.

In the illustrated embodiment, the profiled groove 192 includes a first inclined surface 242, a second inclined surface 244, and third inclined surface 246, and a fourth inclined surface 248. During plugging of the connector module 106 into the latch assembly 120 and during ejection of the connector module 106 from the latch assembly 120, the first inclined surface 232 of the cam is configured to interact with the first inclined surface 242 of the profiled grove 192. Similarly, the second inclined surface 234 interacts with the second inclined surface 244, the third inclined surface 236 interacts with the third inclined surface 246 and the fourth inclined surface 238 interacts with the fourth inclined surface 248. The first inclined surfaces 232, 242 have similar angles. Similarly, the second inclined surfaces 234, 244 have similar angles; the third inclined surfaces 236, 246 have similar angles; and the fourth inclined surfaces 238, 248 have similar angles.

During mating of the connector module 106 with the latch assembly 120, the cams 150 are loaded through the cutouts 198 until the cams 150 engage the slider latch 122. The first inclined surface 232 engages the first inclined surface 242. The cams 150 slide along the profiled grooves 192. The cams 150 drive the slider latch 122 to a clearance position at which the cams 150 clear the blocker 220. The cams 150 are then loaded into a latching area 250 of the corresponding profiled grooves 192. The latching area 250 is located under the blocker 220. The latching area 250 is defined, at least in part by the second inclined surface 244 of the profiled groove 192. In an exemplary embodiment, the second inclined surface 244 has a slight angle 252 with respect to the longitudinal axis 170, such as approximately 10°. The angle 252 of the second inclined surface 244 helps draw the connector module 106 into the latch assembly 120. For example, the second inclined surface 244 forces the cam 150 downward as the slider latch 122 is driven to the latched or resting position (e.g. to the right in the view shown in FIGS. 11 and 12).

During ejection, the ejector button 166 is pressed, which drives the slider latch 122 from the latched or resting position to an unlatched position. As the slider latch 122 is moved in the actuation direction (e.g. to the left in the view shown in FIGS. 11 and 12), the third inclined surface 246 is driven into the third inclined surface 236 of the cam 150. The cam 150 slides along the profiled groove 192. The cam 150 and the connector module 106 are driven outward (e.g. in an upward direction in the view shown in FIGS. 11 and 12). The cam 150 is driven to a holding area 254 of the profiled groove 192. In the holding area 254, the cam has not been fully ejected. The cam 150 is clear of the blocker 220 in the holding area 254 and the connector module 106 can be manually pulled out of the latch assembly 120. The cam 150 is driven to the holding area 254 when the ejector button 166 is fully unlatched. When the slider latch 122 is in the unlatched position, the cam 150 is in the holding area 254 and is no longer blocked by the blocker 220.

Once the ejector button 166 is released, the slider latch 122 is forced in a closing direction by the springs 168. As the slider latch 122 is moved from the unlatched position toward the latched or resting position, the blocker 220 engages the cam 150. The blocker 220 is positioned inward of the holding area 254 to ensure that the cam 150 does not move back into the latching area 250, but rather is moved into an ejection area 256 and ultimately is ejected out of the pocket 178. The first inclined surface 242 engages the first inclined surface 232. The blocker 220 forces the cam 150 outward and fully ejects the cam from the pocket 178. As such, the ejection is a two stage ejection process. The first stage is accomplished with moving the slider latch 122 from the latched or resting position to the unlatched position by pressing the ejector button 166. The second stage is accomplished by releasing the ejector button 166 and having the springs 168 force the slider latch 122 to move from the unlatched position to the latched position.

Figure 13:
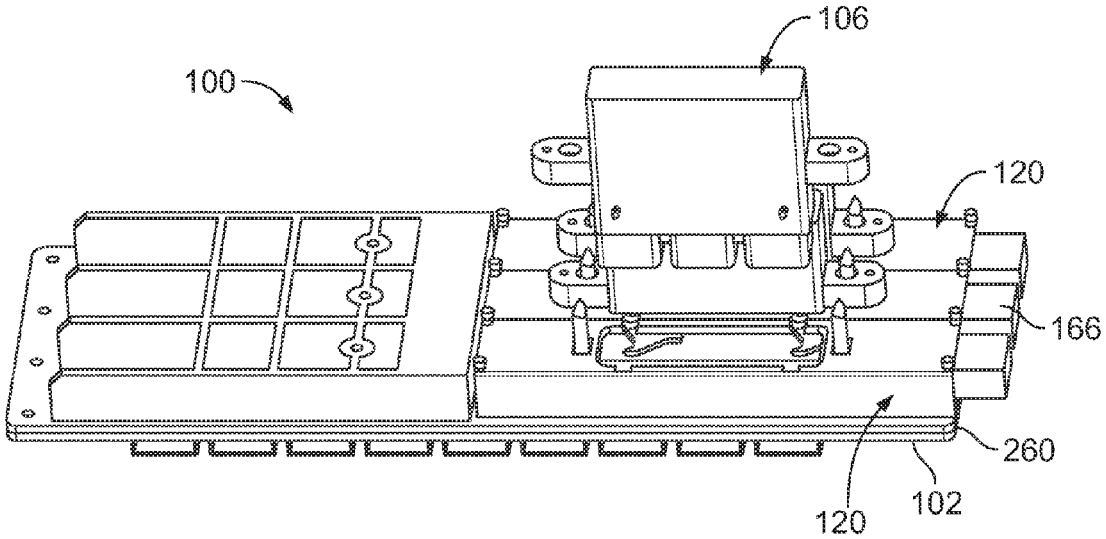
FIG. 13 illustrates the connector system.

FIG. 13 illustrates the connector system 100. One connector module 106 is shown poised for loading into the corresponding latch assembly 120, while two other connector modules 106 are shown loaded into the corresponding latch assemblies 120. The ejector buttons 166 of the latch assemblies 120 are positioned beyond an edge 260 of the backplane 102 and are accessible beyond such edge 260.

Figure 14:
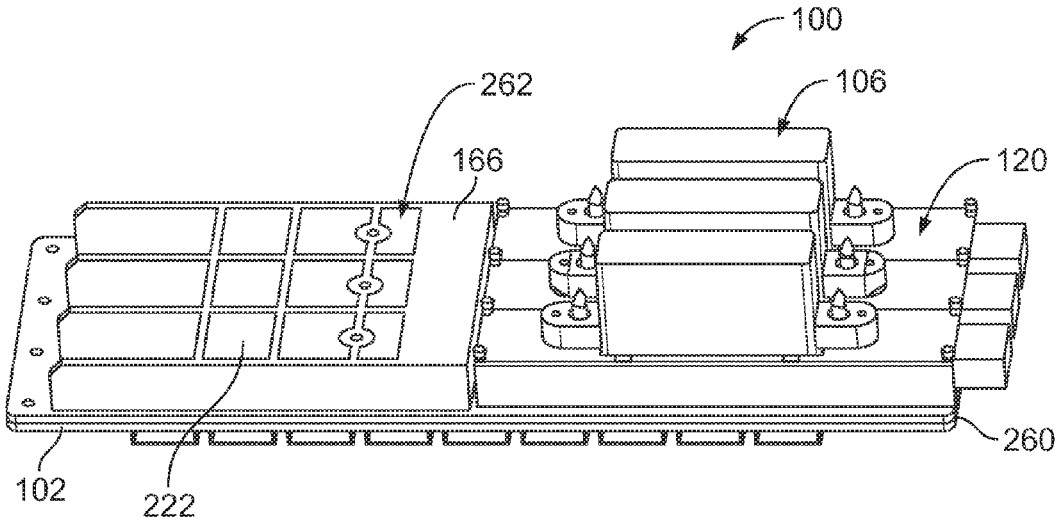
FIG. 14 illustrates the connector system.

FIG. 14 illustrates the connector system 100. The connector modules 106 are shown loaded into the corresponding latch assemblies 120. The ejector buttons 166 of the latch assemblies 120 are positioned interior of the perimeter of the backplane 102 and are accessible through an opening 262 in the stiffener 222 so as to not interfere with other components beyond the edge 260 and to not increase the size of the connector system 100.

Figure 15:
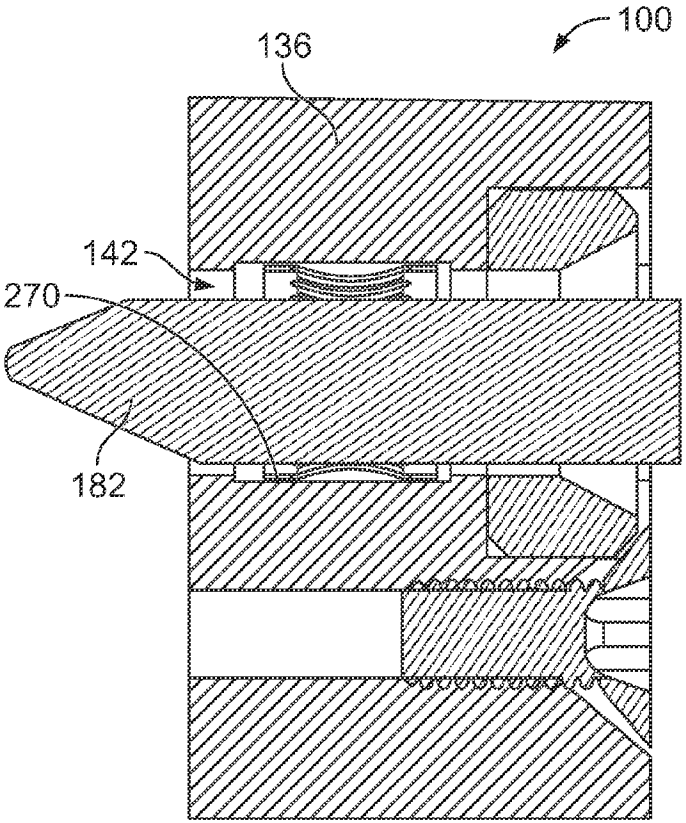
FIG. 15 illustrates a portion of the connector system.

FIG. 15 illustrates a portion of the connector system 100 showing the guide post 182 extending through the post hole 142 in the mounting lug 136. A contact spring 270 is provided in the post hole 142. The contact spring 270 engages the mounting lug 136 and is electrically connected to the mounting lug 136. When the guide post 182 extends into the post hole 142, the guide post 182 engages the contact spring 270. The contact spring 270 is resiliently coupled to the guide post 182. The contact spring 270 provides a grounding path between the guide post 182 and the mounting lug 136. Other types of grounding structures may be provided between the guide post 182 and the mounting lug 136 in alternative embodiments.

Figure 16:
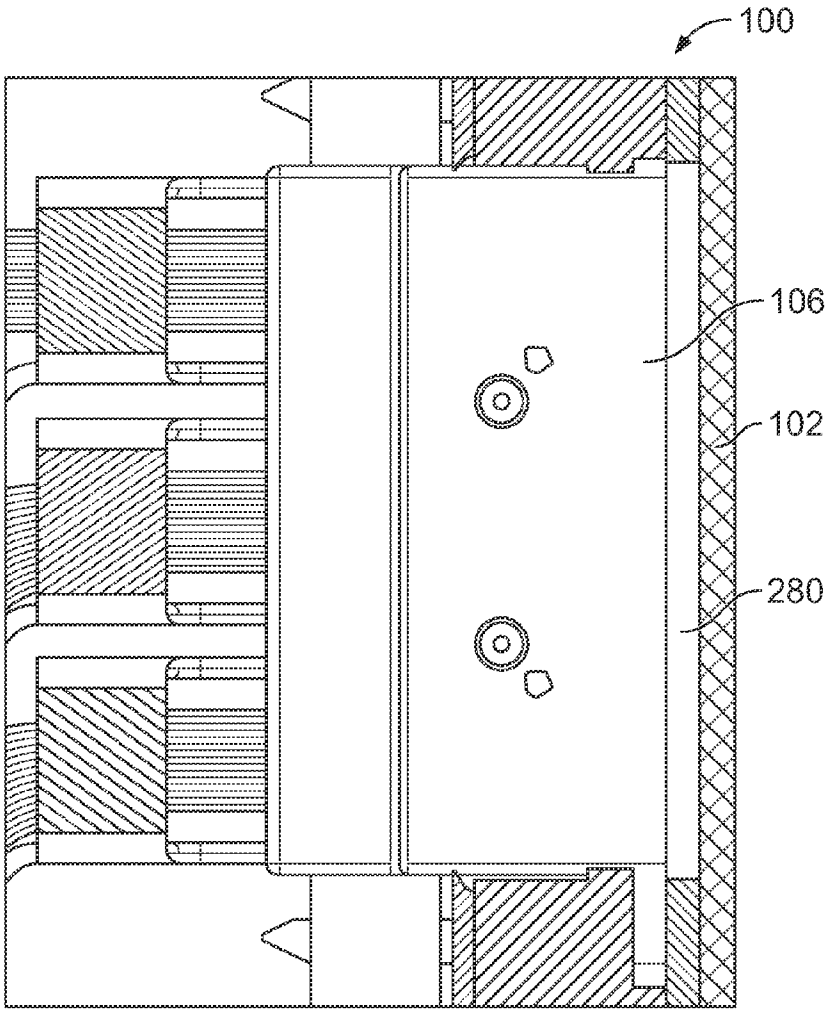
FIG. 16 illustrates a portion of the connector system.

FIG. 16 illustrates a portion of the connector system 100 showing a seal 280 between the connector module 106 and the backplane 102. The seal 280 may be an environmental seal and/or an electrical seal. The seal 280 may be a compression gasket, o-ring or other type of perimeter seal. The gasket may include metal particles to provide electrical shielding in addition to environmental sealing. The seal 280 may be a metal spring to provide electrical shielding from EMI or other types of interference. The seal 280 may be coupled to the backplane 102, or alternatively may be coupled to the connector module 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a base mount configured to hold a connector module therein;

a slider latch received in the base mount and movable in a longitudinal direction, the slider latch having a profiled groove configured to latchably receive a cam of the connector module;

a faceplate coupled to the base mount, the faceplate having an opening providing access to the slider latch, the base mount being configured to receive the connector module through the opening in the faceplate;

an ejector button operatively coupled to the slider latch to move the slider latch from an latched position to an unlatched position, the slider latch being configured to eject the connector module as the slider latch moves between the latched and unlatched positions; and a spring engaging the slider latch, the spring acting on the slider latch in a biasing direction, the spring forcing the slider latch to return to the latched position after the ejector button is released.

2. The connector system of claim 1, wherein the slider latch provides a two staged ejection process, a first stage accomplished with moving the slider latch from the latched position to the unlatched position and a second stage accomplished the slider latch from the unlatched position to the latched position.

3. The connector system of claim 1, wherein the slider latch is automatically unlatched during loading of the connector module into the base mount.

4. The connector system of claim 1, wherein the base mount includes a biasing wall, the spring being positioned between the biasing wall and the slider latch.

5. The connector system of claim 1, wherein the profiled groove includes a latching area in which the cam is captured to secure the connector module, the profiled groove including a first inclined surface and a second inclined surface, the second inclined surface engaging the cam and driving the cam out of the latching area as the ejector button is unlatched, the first inclined surface engaging the cam and ejecting the connector module from the base mount as the spring returns the slider latch from the unlatched position to the latched position.

6. The connector system of claim 1, wherein the profiled groove includes a latching area in which the cam is captured to secure the connector module, the profiled groove includes an ejection area from which the cam is ejected from the profiled groove, and the profiled groove includes a holding area between the ejection area and the latching area, the cam being moved from the latching area to the holding area as the ejector button is pressed and the slider latch is moved to the unlatched position, the cam being moved from the holding area to the ejection area and then being ejected from the profiled groove as the ejector button is released and the spring forces the slider latch to move to the latched position.

7. The connector system of claim 6, wherein the cam is unable to return to the latching area from the holding area without pressing the connector module in a loading direction into the base mount.

8. The connector system of claim 6, wherein the profiled groove include a blocker between the latching area and the ejection area, the profiled groove including an inclined surface extending between the blocker and the face plate along the ejection area, the blocker stopping the cam from returning to the latching area and the inclined surface forcing the cam to ride along the inclined surface.

9. The connector system of claim 1, wherein the face plate includes a cutout aligned with the profiled groove.

10. The connector system of claim 1, further comprising guide posts coupled to the base mount, the guide posts configured to locate the connector module with respect to the opening, the guide posts being keyed to mate with a certain type of connector module, wherein the guide posts are configured to be positioned at different rotational positions to define different interfaces from mating with different types of connector modules.

11. A connector system comprising:

a backplane having a connector channel therethrough;

a connector module received in the connector channel for mating with a mating connector module, the connector module having a profiled cam; and a latch assembly releasable coupling the connector module to the backplane, the latch assembly comprising:

a base mount coupled to the backplane, the base mount having a pocket receiving the connector module therein;

a slider latch received in the pocket of the base mount and movable in a longitudinal direction therein, the slider latch having a profiled groove latchably receiving the profiled cam of the connector module;

a faceplate coupled to the base mount, the faceplate having an opening providing access to the pocket;

an ejector button operatively coupled to the slider latch to move the slider latch from an latched position to an unlatched position; and a spring engaging the slider latch, the spring acting on the slider latch in a biasing direction, the spring forcing the slider latch to return to the latched position after the ejector button is released;

wherein the slider latch ejects the connector module as the slider latch moves between the latched and unlatched positions.

12. The connector system of claim 11, wherein the slider latch provides a two staged ejection process, a first stage accomplished with moving the slider latch from the latched position to the unlatched position and a second stage accomplished the slider latch from the unlatched position to the latched position.

13. The connector system of claim 11, wherein the slider latch is automatically unlatched during loading of the contact module into the base mount.

14. The connector system of claim 11, wherein the base mount includes a biasing wall, the spring being positioned between the biasing wall and the slider latch.

15. The connector system of claim 11, wherein the profiled groove includes a latching area in which the cam is captured to secure the connector module, the profiled groove including a first inclined surface and a second inclined surface, the second inclined surface engaging the cam and driving the cam out of the latching area as the ejector button is unlatched, the first inclined surface engaging the cam and ejecting the connector module from the base mount as the spring returns the slider latch from the unlatched position to the latched position.

16. The connector system of claim 11, wherein the profiled groove includes a latching area in which the cam is captured to secure the contact module, the profiled groove includes an ejection area from which the cam is ejected from the profiled groove, and the profiled groove includes a holding area between the ejection area and the latching area, the cam being moved from the latching area to the holding area as the ejector button is pressed and the slider latch is moved to the unlatched position, the cam being moved from the holding area to the ejection area and then being ejected from the profiled groove as the ejector button is released and the spring forces the slider latch to move to the latched position.

17. The connector system of claim 16, wherein the cam is unable to return to the latching area from the holding area without pressing the connector module in a loading direction into the bas mount.

18. The connector system of claim 16, wherein the profiled groove include a blocker between the latching area and the ejection area, the profiled groove including an inclined surface extending between the blocker and the face plate along the ejection area, the blocker stopping the cam from returning to the latching area and the inclined surface forcing the cam to ride along the inclined surface.

* * * * *